United States Patent [19]

Steiger Jr., H. M. et al.

[11] Patent Number: 4,854,856

[45] Date of Patent: Aug. 8, 1989

[54] CONTAINER OPENER AND LIGHTER COMBINATION

[75] Inventors: Steiger Jr., H. M., Scottsdale, Ariz.; Victor M. Catania, Port Richey, Fla.

[73] Assignee: V and H Enterprises, Ltd., Buffalo, N.Y.

[21] Appl. No.: 216,002

[22] Filed: Jul. 7, 1988

[51] Int. Cl.[4] ..... B25F 1/00; B67B 7/44

[52] U.S. Cl. ..... 431/253; 81/3.09; 81/3.55; 206/86; 206/234; 131/185; 7/151

[58] Field of Search ..... 81/3.09, 3.55, 3.4; 131/185; 7/151, 167, 170; 206/86, 38, 37, 234; 431/253

[56] References Cited

U.S. PATENT DOCUMENTS

| | | | |
|---|---|---|---|
| 2,558,265 | 6/1951 | Mosch | 206/38 |
| 2,828,855 | 4/1958 | Mosch | 206/38 |
| 4,133,228 | 1/1979 | DePooter | 81/3.09 |
| 4,361,920 | 12/1982 | Zanni | 7/151 |
| 4,373,223 | 2/1983 | Miller | 7/151 |
| 4,486,169 | 12/1984 | Lewis | 431/253 |
| 4,560,344 | 12/1985 | Kietaibl | 431/253 |
| 4,569,653 | 2/1986 | Becker | 431/253 |
| 4,607,407 | 8/1986 | Bergmeister | 81/3.09 |
| 4,625,861 | 12/1986 | Krog | 7/151 |

*Primary Examiner*—Roscoe V. Parker

*Attorney, Agent, or Firm*—LaValle D. Ptak

[57] ABSTRACT

A combination lighter and container opener includes an elongated handle which has a container opener member at one end. The other end of the handle has a pair of rolled under and inwardly turned flanges oriented to permit the frictional wedging engagement of the fuel tank portion of a disposable lighter, leaving the igniter portion of the lighter extending beyond the other end of the handle. The handle has a length which is greater than the length of the lighter, and the flanges are spaced apart to permit a lighter to be pushed out of the handle for replacement with a new one when the fuel is spent.

10 Claims, 1 Drawing Sheet

CONTAINER OPENER AND LIGHTER COMBINATION

BACKGROUND

Two separate, simple tools, namely container openers and lighters, such as cigarette lighters, typically are used in close physical proximity to one another. Container openers designed to remove crown caps from bottles or cans or to assist in the opening of "pull tab" cans have been incorporated into a variety of different devices. In the simpliest form, such container openers are attached to a handle and are sold and used as a separate tool. Frequently, such tools are incorporated into other devices, such as jacknives, with fold out container openers in them. Frequently, bottle openers are attached to the sides of ice chests, or other containers for beverages, to provide ready access to the bottle opener.

Cigarette lighers, both liquid fueled and gas fueled, also typically are a separate item. Consequently, a person desiring to have both a cigarette lighter and a container opener on his person must carry two separate items. Although many situations exist when only a lighter is desired or only a container opener is desired, there are a large number of applications when it is desirable to have both a lighter and a container opener available together in the same place.

Attempts have been made in the past to combine lighters, such as cigarette lighters, with bottle openers or container openers. Three patents directed to devices which incorporate a disposable cigarette lighter and a bottle opener are the Patents to Miller U.S. Pat. No. 4,373,223; Kietaibl U.S. Pat. No. 4,560,344; and Becker U.S. Pat. No. 4,569,653. In the tools disclosed in each of these patents, a sleeve is provided into which the cigarette lighter is placed. In the devices of Miller and Kietaibl, the sleeve essentially encloses the entire fuel tank portion of the lighter, with the igniter portion exposed at the open end of the sleeve. In these patents, the bottom of the sleeve is provided with a built-in bottle opener mechanism.

The device of the Becker Patent is similar in many respects to the ones of Miller and Kietabl, but the sleeve into which the lighter is placed is much shorter than the fuel tank portion of the lighter and merely encases the bottom third of the lighter. In the devices of all three of the Patents to Miller, Kietabl and Becker, it is necessary to grasp the outer portion of the sleeve and somehow grip the upper portion of the lighter to pull it out of the sleeve when a new lighter is to replace one in which the fuel has been expended. If the frictional engagement between the lighter and the sleeve in the devices of each of these patents is sufficient to securely hold the lighter in place, removal of a lighter to replace it is difficult, particularly for the devices disclosed in the Miller and Kietabl Patents, since only the igniter portion of the lighter extends beyond the open end of the sleeve. The lighter must be pulled out of the sleeve in the devices of all three of these patents since the bottom of the sleeve is closed and has the container opener attached to it.

A Patent to Zanni U.S. Pat. No. 4,361,920 also discloses a combined bottle opener and gas lighter. In Zanni, however, the lighter cannot be separated from the bottle opener. Consequently, if the lighter is a disposable lighter, the entire tool must be discarded.

Two other patents which disclose the incorporation of a bottle opener into a multiple purpose tool, are the Patents to Mosch U.S. Pat. Nos. 2,558,265 and 2,828,855. Both of these patents show a bottle opener built into a composite tool which includes a built-in cigarette lighter. The lighter is not a separate disposable lighter, but forms an integral part of the tool. Consequently, if the lighter should become defective or unusable, the entire tool must be discarded if the lighter function continues to be desired.

It is desirable to provide a simple combined container opener and lighter which overcomes the disadvantages of the prior art mentioned above and which is inexpensive and simple to use.

SUMMARY OF THE INVENTION

Accordingly, it is a preferred embodiment of this invention to provide an improved combination container opener and lighter.

It is another object of this invention to provide an improved container opener and lighter combination for use in conjunction with disposable lighters.

It is another object of this invention to provide an improved container opener with a handle for removably holding a lighter.

It is a further object of this invention to provide an elongated handle for a container opener which has an open-ended sleeve for removably holding a disposable lighter on the end opposite the end to which the container opener is attached.

In accordance with a preferred embodiment of this invention, a combination lighter and container opener is made with an elongated handle. This handle has a container opener member at one end and a lighter receiving pair of inwardly turned flanges on the other end for frictionally engaging a disposable lighter between the flanges.

DETAILED DESCRIPTION

Figure 1:
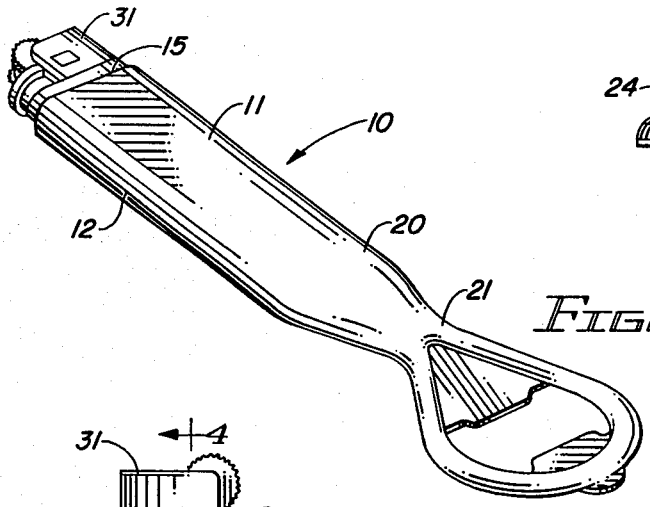
FIG. 1 is a perspective view of a preferred embodiment of the invention.
Figure 2:
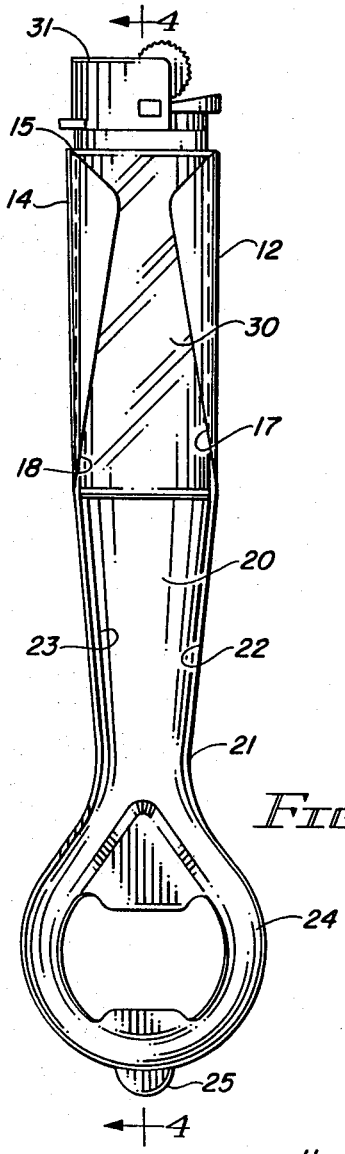
FIG. 2 is a bottom view of the embodiment of FIG. 1.
Figure 3:
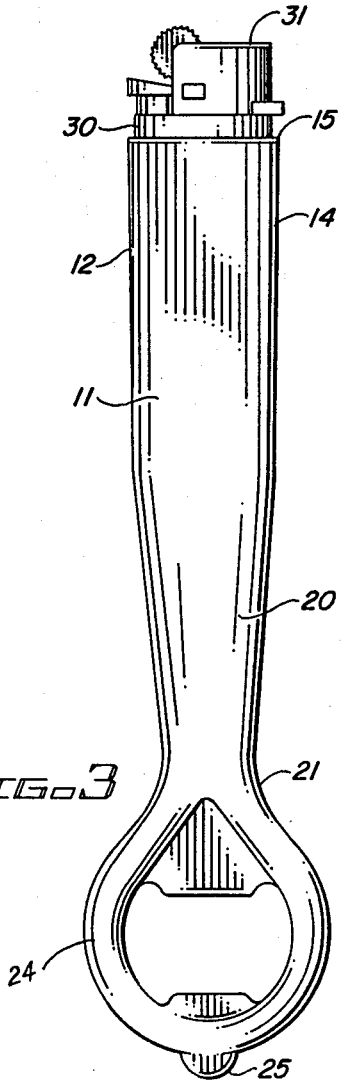
FIG. 3 is a top view of the embodiment of FIG. 1.

Reference now should be made to the drawing in which the same reference numbers are used throughout the different figures to designate the same components. FIG. 1 is a perspective view of a preferred embodiment of the tool 10; and FIGS. 2 and 3 show, respectively, the bottom and top of the tool of FIG. 1.

The tool 10 comprises an elongated handle 11 which preferably is made of stamped steel material. The handle 11 is somewhat tapered at one end in a section 20 which terminates in a neck 21, to which a standard crown type of bottle opener 24 is attached. At the outer end of the bottle opener 24 is a tab 25, which is used to lift or pry up pull tabs of the type used on tab top beverage containers.

Figure 5:
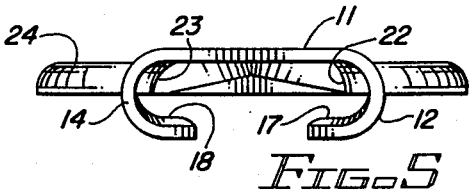
FIG. 5 is an end view of the embodiment of FIG. 1.
Figure 4:
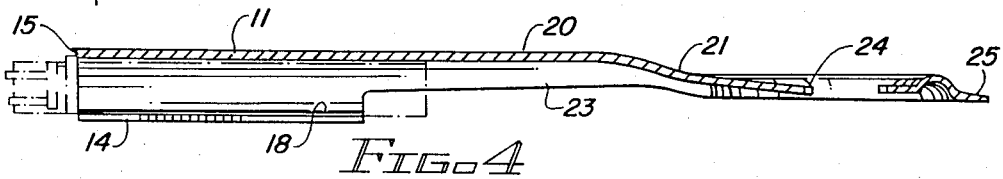
FIG. 4 is a cross-sectional view taken along the line 4—4 of FIG. 2.

To provide a comfortable hand grip and to prevent any sharp edges from engaging the fingers of the user of the bottle opener 24 or tab lift projection 25, the edges of the handle 11 of the tool 10 are downwardly turned in the region of the neck 20 to form a pair of edge flanges 22 and 23 (shown most clearly in FIGS. 4 and 5). At the upper end of the handle (as viewed in FIGS. 1 through 3), a pair of downwardly turned gripping flanges 12 and 14 are provided and these flanges also are inwardly turned to wrap partially around a space beneath the bottom or inner surface of the handle 11, as shown most clearly in FIGS. 2, 4, and 5.

The flanges 12 and 14 are widest near the open end 15 of the handle and taper to merge with the flanges 22 and 23, respectively, at approximately the mid-point of the tool 10. The distance between the downwardly turned inner edges of the flanges 12 and 14 tapers inwardly from a maximum at the end 15 to a minimum near the portion 20 of the handle. In addition, the edges 17 and 18 are slightly closer to the inner surface of the handle 11 than the distance between the handle 11 and the inwardly turned portions of the flanges 12 and 14 at the end 15 (this is illustrated in FIG. 5).

With the opening provided by the inwardly turned flanges 12 and 14, and the tapers described above, a disposable cigarette lighter 30 of a type commercially available may be inserted through the open end 15 to be frictionally engaged in and wedged into a secure fit with the handle 11 at the regions 17 and 18. The case of the cigarette lighter 31 is wedged on both edges; and also is wedged between the inside or bottom of the handle 11 and the flanges 12 and 14. This is a secure fit; and when the lighter 30 is pressed into place, leaving the igniter end 31 exposed, it is securely held in place on the handle 11 of the tool 10. The tool itself then readily may be used to open containers, utilizing either of the openers 24 and 25 on the lower end (as viewed in FIGS. 2 and 3), or to employ the lighter 30, 31 at the upper end.

When the fuel in the disposable lighter 30 is expended, it readily may be removed by applying a force to the exposed lower end of the lighter between the inwardly turned flange portions 17 and 18 to permit it to be slid outwardly through the open end 15. This easily may be done by using the thumb or, if desired, some type of rigid pushing member may be employed. The device used to push the lighter 30 out of the open end 15 of the tool may pass through the opening between the edges of the inwardly turned flanges 12 and 14, so that removal of the lighter 30 readily and easily is effected. A new lighter 30 then may be inserted into the tool in the same manner described previously.

The foregoing description of the preferred embodiment of the invention is to be considered as illustrative only of the invention and not as limiting. Various changes and modifications will occur to those skilled in the art without departing from the true scope of the invention as defined in the appended claims. For example, the inwardly turned gripping flanges 12 and 14 do not necessarily need to be tapered in the manner shown, but may be made in a shape which provides a uniform space between them throughout the length of these flanges. Other types of container openers differing from the ones illustrated in the drawing, also may be employed.

We claim:

1. A combination lighter and container opener device, for use with a lighter having a fuel tank portion and an igniter portion, said device comprising:

an elongated handle having a container opener member at one end thereof and a lighter receiving means at the other end thereof;

said lighter receiving means comprising a pair of inwardly turned elongated gripping flanges spaced from and underlying said handle and extending a predetermined distance from said other end of said handle toward said one end, with said flanges oriented with a predetermined taper wider at said other end and narrower toward said one end to frictionally and releasably wedge the bottom of the fuel tank portion of a lighter inserted between said gripping flanges and said handle so that said lighter frictionally engages said flanges and said handle as the bottom of such lighter is pushed toward said one end of said handle, thereby to releasably securing such lighter in said receiving means.

2. The combination according to claim 1 wherein the length of said handle is substantially greater than the length of a lighter to be inserted into said lighter receiving means.

3. The combination according to claim 1 wherein said handle has an upper surface and downwardly turned edges, with said flanges extending a predetermined distance from said other end thereof toward said one end thereof, said predetermined distance being less than the length of said handle.

4. The combination according to claim 3 wherein a space is provided between said flanges to permit the bottom of a lighter inserted therebetween to be pushed out of engagement with said handle and said flanges for removing such lighter.

5. The combination according to claim 4 wherein said container opener member comprises a multi-function container opener.

6. The combination according to claim 5 wherein said opener member comprises a first portion thereof for removing caps from bottles and a second portion thereof for lifting pull-tabs on cans.

7. The combination according to claim 1 wherein said gripping flanges have an open space therebetween.

8. The combination according to claim 1 wherein a space is provided between said flanges to permit the bottom of a lighter inserted therebetween to be pushed out of engagement with said handle and said flanges for removing such lighter.

9. The combination according to claim 1 wherein said container opener member comprises a multi-function container opener.

10. The combination according to claim 1 wherein said opener member comprises a first portion thereof for removing caps from bottles and a second portion thereof for lifting pull-tabs on cans.

* * * * *